US007106154B2

(12) United States Patent
Takano et al.

(10) Patent No.: US 7,106,154 B2
(45) Date of Patent: Sep. 12, 2006

(54) ELECTROMAGNETIC RELAY

(75) Inventors: Satoshi Takano, Shinagawa (JP); Shigemitsu Aoki, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 10/916,428

(22) Filed: Aug. 12, 2004

(65) Prior Publication Data

US 2005/0040920 A1 Feb. 24, 2005

(30) Foreign Application Priority Data

Aug. 22, 2003 (JP) ..... 2003-298963

(51) Int. Cl.
*H01H 67/02* (2006.01)

(52) U.S. Cl. ..... 335/129; 335/128

(58) Field of Classification Search ..... 335/78–86, 335/124, 128–132, 202
See application file for complete search history.

(56) References Cited

U.S. PATENT DOCUMENTS 4,309,682 A * 1/1982 Arnoux et al. ..... 335/128
4,949,058 A * 8/1990 Nishikawa et al. ..... 335/128
5,216,397 A * 6/1993 Matsuoka et al. ..... 335/83
5,844,456 A * 12/1998 Mader ..... 335/78

FOREIGN PATENT DOCUMENTS

| | | |
|---|---|---|
| JP | 2893601 | 3/1999 |
| JP | 11-213833 | 8/1999 |
| JP | 2001-14996 | 1/2001 |

* cited by examiner

*Primary Examiner*—Lincoln Donovan
(74) *Attorney, Agent, or Firm*—Staas & Halsey LLP

(57) ABSTRACT

An electromagnetic relay including a base having a first receptacle, a second receptacle and a partition wall defining the first and second receptacles on mutually opposite sides of the partition wall. The partition wall includes a major part and an auxiliary part, the major part being provided with a local opening. An electromagnet assembly is received in the first receptacle of the base and includes an electromagnet and an armature. The armature includes an extending portion extending in a direction toward the second receptacle of the base through the local opening of the partition wall. The auxiliary part of the partition wall is disposed between the electromagnet and the extending portion of the armature. A contact section is received in the second receptacle of the base. An actuating member is arranged between the electromagnet assembly and the contact section, and includes an envelope part for enclosing at least a part of the extending portion of the armature. When the contact section is opened, the envelope part of the actuating member is supported by the auxiliary part of the partition wall.

5 Claims, 11 Drawing Sheets

ELECTROMAGNETIC RELAY

BACKGROUND OF THE INVENTION

1. Field of the Invention

The present invention relates to an electromagnetic relay.

2. Description of the Related Art

In an electromagnetic relay including an electromagnet assembly and a contact section acting to open or close in accordance with the operation of the electromagnet assembly, both incorporated in a common base, it is known that the components of the electromagnet assembly and the components of the contact section are assembled or inserted into the mutually opposite sides of the base, for the purpose of ensuring an electrical insulation distance or clearance in terms of "creepage" (or a so-called creeping distance) between the electromagnet assembly and the contact section (see, e.g., Japanese Unexamined Patent Publication (Kokai) No. 11-213833 (JP-A-11-213833)). In the electromagnetic relay described in JP-A-11-213833, the base is provided with a first receptacle for receiving the electromagnet assembly, a second receptacle for receiving the contact section, and a partition wall defining the first and second receptacles on the mutually opposite sides of the partition wall. The partition wall of the base has a shape (referred to as "a crank shape" in JP'833) for regulating the direction of assembling of the electromagnet assembly into the first receptacle as to be reverse to the direction of assembling of the contact section into the second receptacle.

On the other hand, various electromagnetic relays have been developed in the field of, e.g., an application to switch a high voltage load, wherein each of a stationary contact member and a movable contact member, constituting the contact section, is provided at one longitudinal end with a board terminal connectable to a circuit board and at the other longitudinal end with a tab terminal connectable to a female-type terminal element. For example, Japanese Unexamined Patent Publication (Kokai) No. 2001-14996 (JP-A-2001-14996) describes an electromagnetic relay with a tab terminal, which is configured so that a stationary contact carried on the intermediate region of the stationary contact member and a movable contact carried on the intermediate region of the movable contact member are disposed at a location close to a yoke, the yoke being provided in the electromagnet assembly at the lateral side (or the radially outside) of a coil provided in the electromagnet assembly, and that a portion of an armature provided in the electromagnet assembly lies between the contact section (especially, the stationary and movable contacts) and the yoke. In the electromagnetic relay described in JP-A-2001-14996, an insulating wall extending from the base is inserted between the coil and the yoke in the electromagnet assembly, which are disposed to be overlapped on one another as seen in a radial direction of the coil, for the purpose of improving an insulating property between the coil and the contact section (the stationary and movable contacts).

Further, in an electromagnetic relay with a tab terminal, such as one described in JP-A-2001-14996, it has also been proposed to adopt the configuration in which the components of the electromagnet assembly and the components of the contact section are assembled onto the mutually opposite sides of the base in a way similar to JP-A-11-213833 (see, e.g., Japanese Patent No. 2893601 (JP-B-2893601)).

The electromagnetic relay described in JP-A-2001-14996 is configured so that the insulating wall is disposed between the coil and the yoke in the electromagnet assembly for improving the insulating effect between the electromagnet assembly and the contact section. As a result, there is a problem in that the external dimension of the electromagnetic relay as seen in a radial direction of the coil (or a height dimension) is increased, or that, under a given limitation on the external dimension, a space for disposing the coil on the base is reduced and, as a result, a magnetic attractive force is diminished. In contrast to this, in the electromagnetic relay described in JP-B-2893601, in which the components of the electromagnet assembly and the components of the contact section are assembled onto the mutually opposite sides of the base, it is possible to increase the creeping distance between the electromagnet assembly and the contact section, in comparison with the electromagnetic relay of JP-A-2001-14996, and therefore, no insulating wall is provided between the coil and the yoke in the electromagnet assembly. However, in the latter configuration, it is desired to further improve the insulating property between the electromagnet assembly and the contact section, particularly for an application to switch a high voltage load.

SUMMARY OF THE INVENTION

It is an object of the present invention to provide an electromagnetic relay capable of ensuring a desired insulation distance between an electromagnet assembly and a contact section, and of increasing a magnetic attractive force of an electromagnet without increasing the external dimension thereof, so as to provide high structural reliability and stable operating characteristics to the electromagnetic relay.

It is another object of the present invention to provide an electromagnetic relay with a tab terminal, which possesses the improvement of an insulating property as described above.

To accomplish the above object, the present invention provides an electromagnetic relay comprising a base including a first receptacle, a second receptacle and a partition wall defining the first and second receptacles on mutually opposite sides of the partition wall, the partition wall including a major part and an auxiliary part extending from the major part, the major part being provided with a local opening communicating the first and second receptacles with each other; an electromagnet assembly incorporated in the base to be received in the first receptacle of the base and including an electromagnet and an armature driven by the electromagnet, the armature including an extending portion extending in a direction toward the second receptacle of the base through the local opening of the major part of the partition wall, with the auxiliary part of the partition wall being disposed between the electromagnet and the extending portion of the armature; a contact section incorporated in the base to be received in the second receptacle of the base, the contact section being separated from the electromagnet assembly at a predetermined insulation distance; and an actuating member arranged between the electromagnet assembly and the contact section and shiftable under an action of the electromagnet assembly for making the contact section open or close, the actuating member being attached with the armature of the electromagnet assembly and including an envelope part for receiving and enclosing at least a part of the extending portion of the armature, wherein, during an opening condition of the contact section, the envelope part of the actuating member is in contact with and supported by the auxiliary part of the partition wall of the base.

In the above electromagnetic relay, the actuating member may further include an extension locally extending from the envelope part in a direction toward the base for increasing the insulation distance between the electromagnet assembly and the contact section.

Also, the electromagnet of the electromagnet assembly may includes a core provided with an exposed end face; and the armature may further include an attractive end portion intersecting with the extending portion and oppositely facing the end face of the core of the electromagnet and a pair of connecting arm portions integrally connecting the attractive end portion to the extending portion, the connecting arm portions being dimensioned differently from each other.

Also, the contact section may include a movable contact member provided with a contact spring element carrying a movable contact; and the contact spring element of the movable contact member may be provided with a guiding piece for mitigating collision between the contact spring element and the actuating member to eliminate damage of the actuating member during an assembling process of the electromagnetic relay.

Also, the contact section may include a stationary contact member provided with a one-end board terminal, another-end tab terminal and an intermediate stationary contact, and a movable contact member provided with a one-end board terminal, another-end tab terminal and an intermediate movable contact; the electromagnet of the electromagnet assembly may include a yoke constituting a magnetic path; and the armature may be resiliently supported relative to the electromagnet by a leaf spring, the leaf spring being attached in a snap-fit manner at one end thereof to the yoke of the electromagnet.

BRIEF DESCRIPTION OF THE DRAWINGS

The above and other objects, features and advantages of the present invention will become more apparent from the following description of preferred embodiments in connection with the accompanying drawings, wherein.

DETAILED DESCRIPTION

Figure 1:
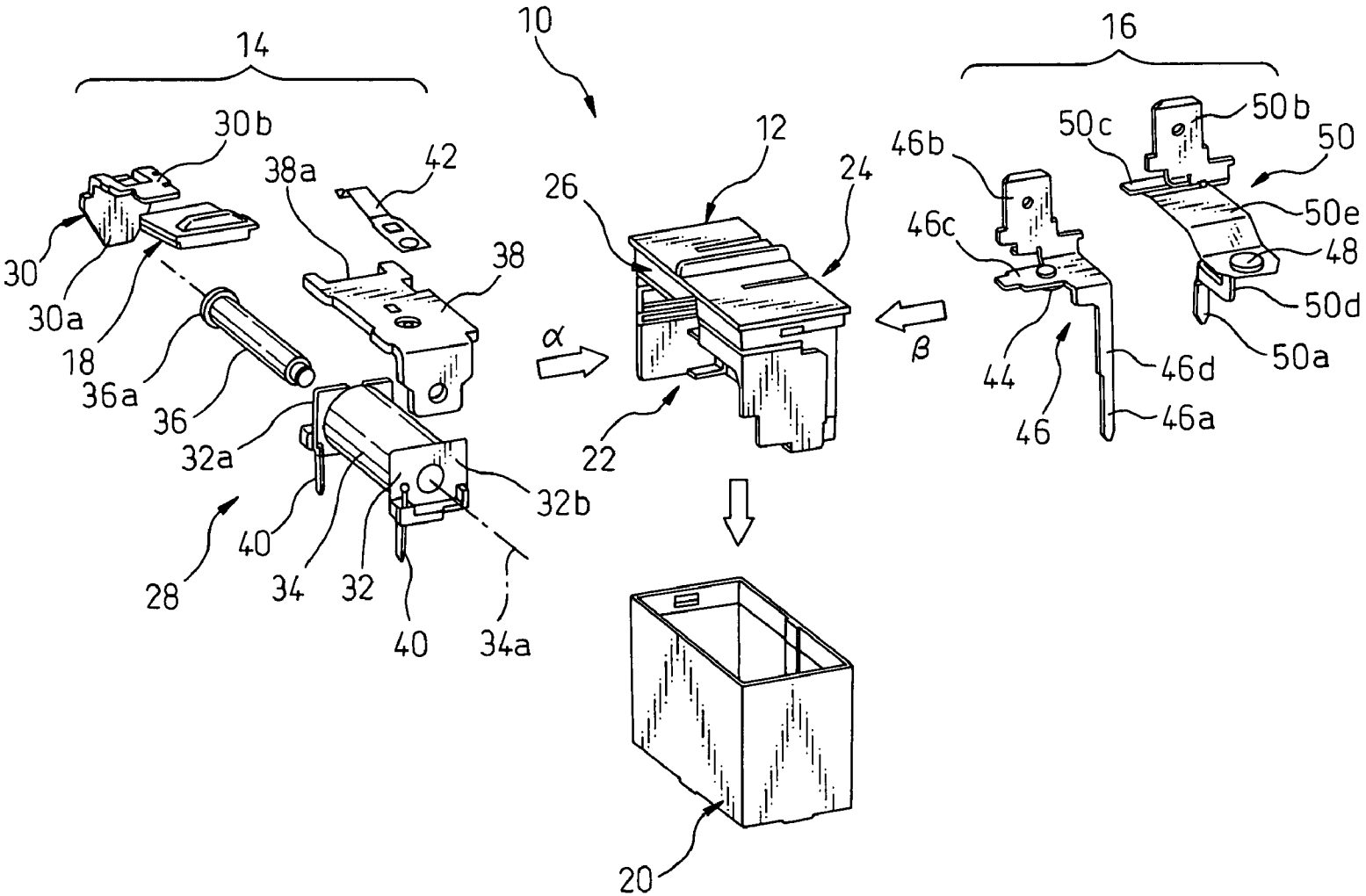
FIG. 1 is an exploded perspective view showing an electromagnetic relay according to one embodiment of the present invention.

The embodiments of the present invention are described below, in detail, with reference to the accompanying drawings. In the drawings, the same or similar components are denoted by common reference numerals.

Figure 2:
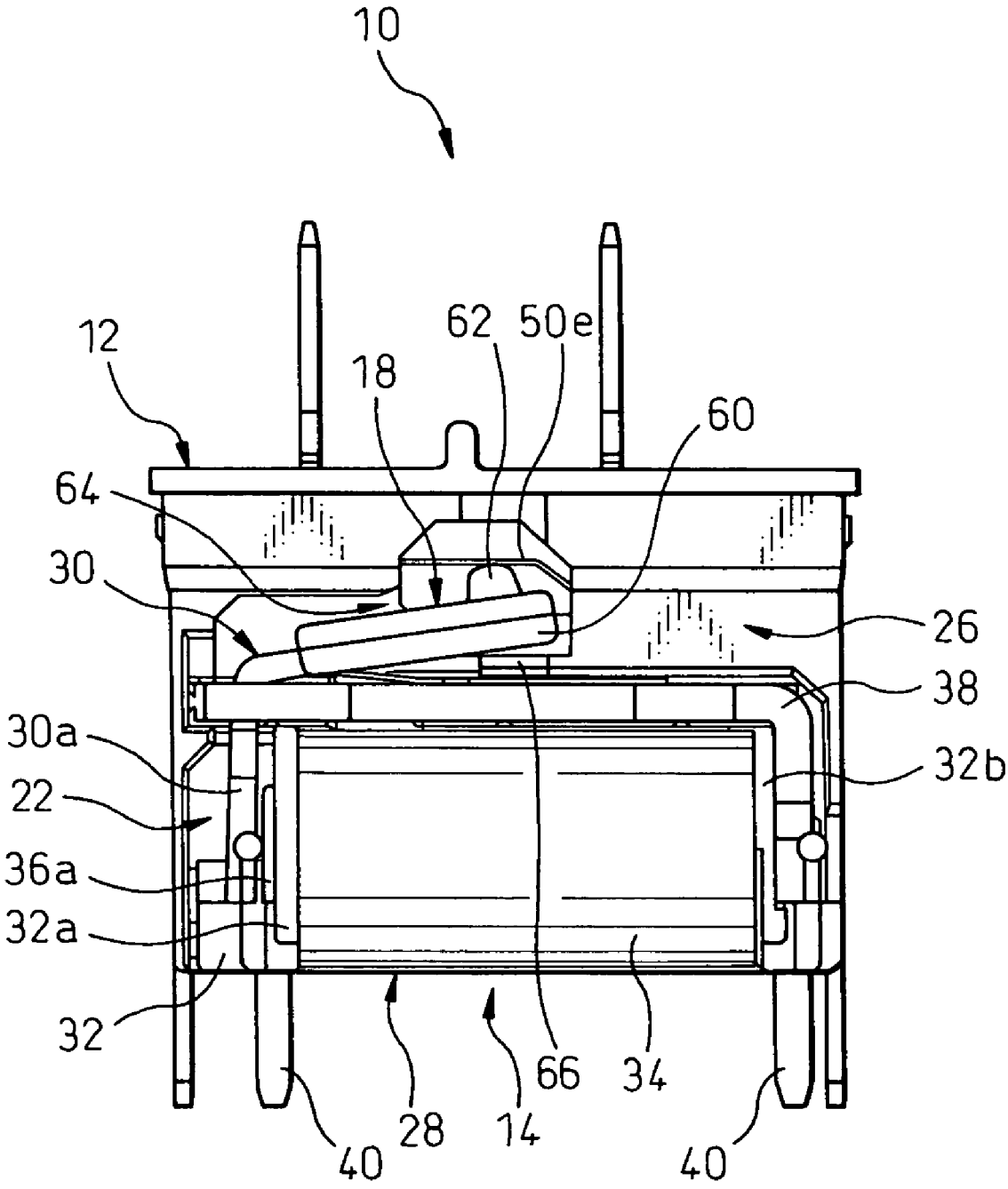
FIG. 2 is a front view showing the electromagnetic relay of FIG. 1 with a case being omitted.
Figure 3:
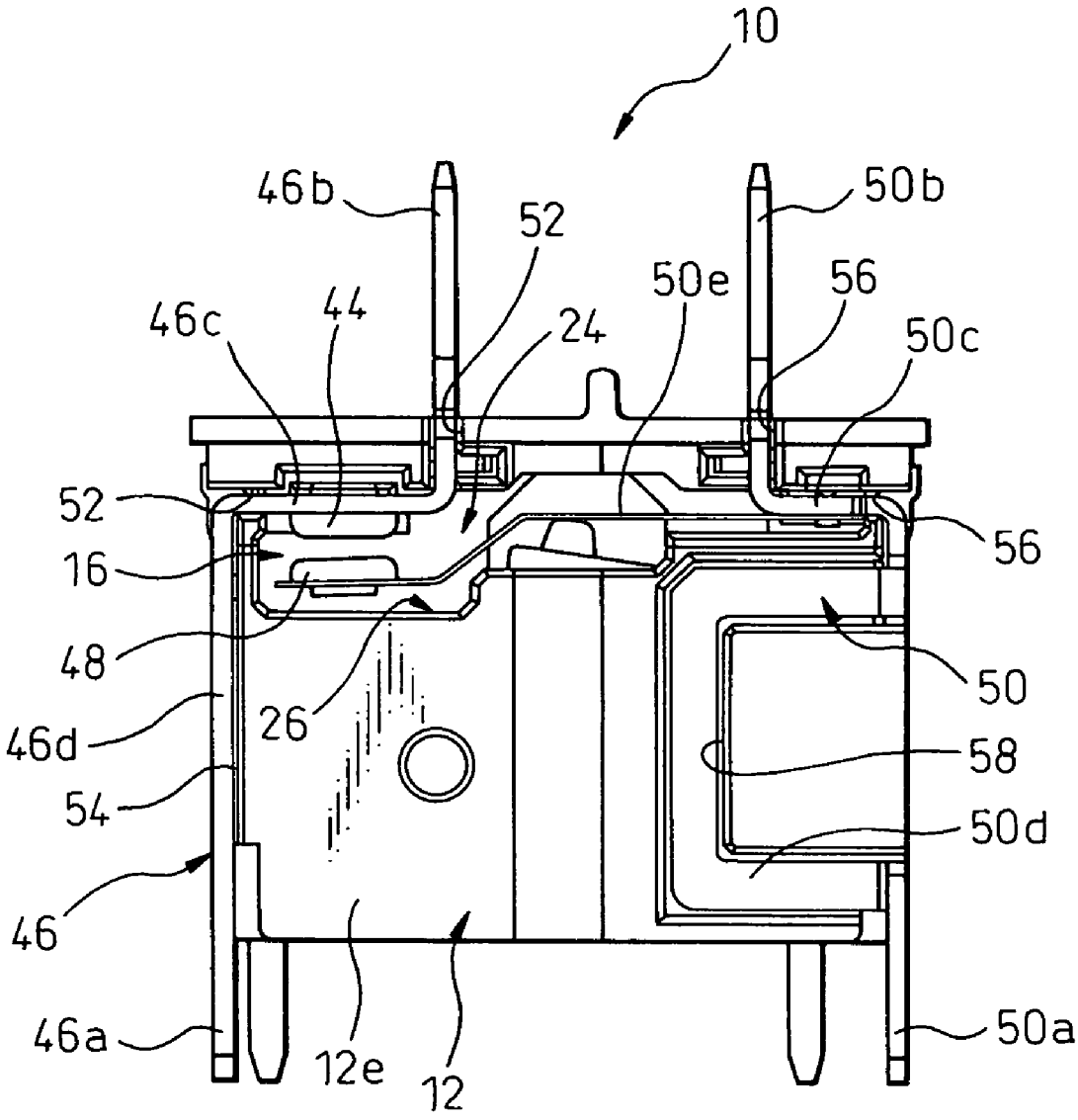
FIG. 3 is a front view showing the electromagnetic relay of FIG. 2 in a direction opposite to FIG. 2.

Referring to the drawings, FIG. 1 is an exploded perspective view of an electromagnetic relay 10 according to one embodiment of the present invention, and FIGS. 2 and 3 are front views respectively showing the electromagnetic relay 10 in mutually opposite directions. The electromagnetic relay 10 includes a base 12, an electromagnet assembly 14 incorporated in the base 12, a contact section 16 incorporated in the base 12 and is separated from the electromagnet assembly 14 at a predetermined insulation distance or clearance, an actuating member 18 arranged between the electromagnet assembly 14 and the contact section 16 and shiftable under the action of the electromagnet assembly 14 for actuating the contact section 16 to be opened or closed, and a hollow box-shaped case 20 containing the above components in a properly assembled condition.

The base 12 is formed from an electrically insulating resinous molded article, and includes a first receptacle 22 receiving the electromagnet assembly 14, a second receptacle 24 receiving the contact section 16, and a partition wall 26 defining the first receptacle 22 and the second receptacle 24 on mutually opposite sides of the partition wall 26. More specifically, with reference to FIGS. 4 and 5, the base 12 is integrally provided with a top plate 12*a* having a substantially rectangular profile in a plan view, a pair of side plates 12*b* parallel to each other and extending along the opposite minor edges of the top plate 12*a* to be perpendicular to the top plate 12*a*, a second end plate 12*c* extending along one major edge of the top plate 12*a* to be perpendicular to the top plate 12*a* and having a vertical extension up to a certain intermediate position of each side plate 12*b* to be joined to both side plates 12*b*, a pair of intermediate plates 12*d* spaced in parallel to and at mutually different distances from the top plate 12*a* and joined to both the respective side plates 12*b* and the second end plate 12*c*, and a first end plate 12*e* extending along edges of both intermediate plates 12*d* at a side opposite to the second end plate 12*c* to be perpendicular to the intermediate plates 12*d* and having a vertical extension up to a lower end of each side plate 12*b* to be joined to both side plates 12*b*.

The first receptacle 22 is defined by the intermediate plates 12*d*, the side plates 12*b* and the first end plate 12*e* in a lower region of the base 12 as seen in the drawings, so as to substantially enclose the electromagnet assembly 14 by these plates from three directions. The second receptacle 24 is defined by the top plate 12*a*, the side plates 12*b*, the second end plate 12*c* and the intermediate plates 12*d* in an upper region of the base 12 as seen in the drawings, so as to be formed as an envelope-like groove for receiving a major part of the contact section 16. The partition wall 26 is an insulating wall member constituted in cooperation of the side plates 12*b*, the second end plate 12*c*, the intermediate plates 12*d* and the first end plate 12*e*, and, as a result of the above-described arrangement of these plates, regulates the direction of assembling or insertion of the electromagnet assembly 14 into the first receptacle 22 (as shown by an arrow $\alpha$ in FIG. 1) as to be reverse to the direction of assembling or insertion of the contact section 16 into the second receptacle 24 (as shown by an arrow $\beta$ in FIG. 1). According to this arrangement, the partition wall 26 lies between the electromagnet assembly 14 and the contact section 16 to ensure the electrical insulation (or a creeping distance) therebetween.

The electromagnet assembly 14 includes an electromagnet 28 and an armature 30 driven by the electromagnet 28. The electromagnet 28 includes a bobbin 32, a coil 34 wound and supported on the bobbin 32, and an iron core 36 attached to the bobbin 32 along a center axis 34*a* of the coil 34. The bobbin 32 is formed of an electrically insulated resinous molded article, and is provided with a hollow body having a predetermined length (not shown) and a pair of flanges 32*a*, 32*b* integrally joined to the opposite longitudinal ends of the body.

The coil 34 is formed by tightly winding a required length of a conductive wire on the body of the bobbin 32, and is securely held between the flanges 32*a*, 32*b* of the bobbin 32. The core 36 is a columnar member made of, e.g., a magnetic steel, and a substantially cylindrical major part thereof is securely received inside the body of the bobbin 32 in an arrangement coaxial with the center axis 34*a* of the coil 34. The core 36 is provided integrally at one axial end thereof with a head 36*a* having a flat end face substantially perpendicular to the coil center axis 34*a*, with the head 36*a* being exposed on the outer surface of the flange 32*a* of the bobbin 32.

A yoke 38 is fixedly connected to another axial end, opposite to the head 36*a*, of the iron core 36 of the electromagnet 28 by, e.g., caulking, to form a magnetic path around the coil 34. The yoke 38 is an L-shaped plate-like member made of, e.g., a magnetic steel, wherein a shorter plate part thereof extends along the flange 32*b* at the other axial end of the bobbin 32 and a longer plate part thereof is laterally spaced from the coil 34 to extend substantially parallel to the coil center axis 34*a*. The longer plate part of the yoke 38 extends so that the distal end 38*a* of the longer plate part reaches a longitudinal position in close proximity to the head 36*a* of the iron core 36, and the armature 30 is supported on the yoke 38 to be adjacent to the distal end 38*a* in a rockable manner. Further, the bobbin 32 is provided with a pair of coil terminals 40 to which winding ends of the coil 34 are connected.

Figure 7:
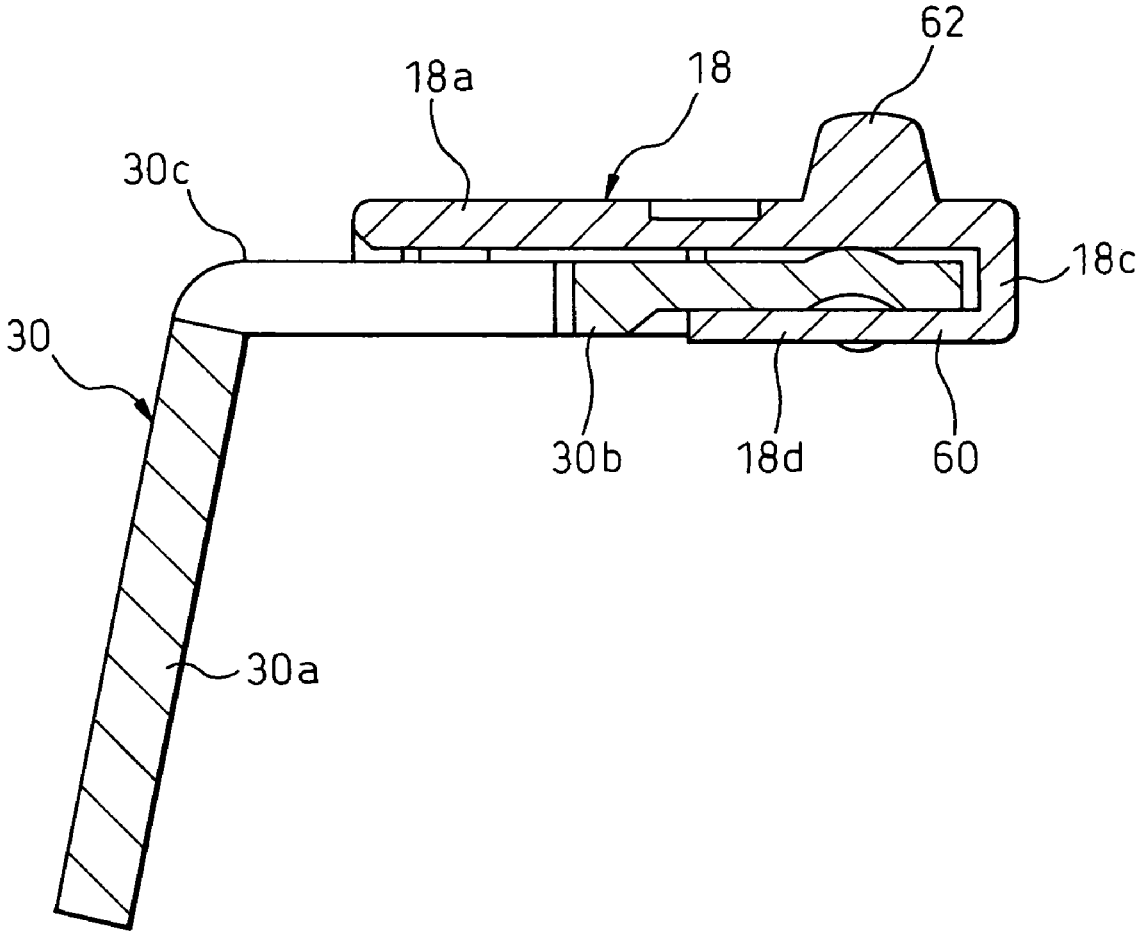
FIG. 7 is a vertical sectional view showing the armature and the actuating member of FIG. 6.

The armature 30 is an L-shaped plate-like member made of, e.g., a magnetic steel, and is resiliently supported on the yoke 38 through a leaf spring 42 in a relatively displaceable manner. The armature 30 includes a flat plate-like first end portion (or an attractive end portion) 30*a* arranged to oppositely face the exposed end face of the head 36*a* of the iron core 36 (FIG. 2), a flat plate-like second end portion (or an extending portion) 30*b* extending to intersect with the attractive end portion 30*a* (FIG. 7), and a bent portion (or a connecting arm portion) 30*c* integrally connecting the attractive end portion 30*a* to the extending portion 30*b* (FIG. 7). The leaf spring 42 acts as an elastic hinge between the yoke 38 and the armature 30, so as to keep the connecting arm portion 30*c* of the armature 30 resiliently pushed against the end portion 38*a* of the yoke 38. When the electromagnet 28 is not excited, the armature 30 is stationarily held in its returned or released position in which the attractive end portion 30*a* is spaced from the head 36*a* of the core 36 by a predetermined distance. When the electromagnet 28 is excited, the armature 30 rocks about the connecting arm portion 30*c* by a magnetic attractive force, in such a direction that the attractive end portion 30*a* moves toward the head 36*a* of the core 36. The extending portion 30*b* of the armature 30 is disposed along the longer plate part of the yoke 38 located at the lateral side of the coil 34, and the actuating member 18 is attached to the extending portion 30*b* in such a manner as described later.

The contact section 16 is constituted from a stationary contact member 46 having a stationary contact 44 and a movable contact member 50 having a movable contact 48. The stationary contact member 46 is formed by stamping and bending an electrically conductive sheet-metal material into a predetermined shape, and includes a pin-shaped board terminal 46*a* arranged at one end, a flat plate-like tab terminal 46*b* arranged at the other end to extend substantially parallel to the board terminal 46*a*, a flat plate-like intermediate portion 46*c* extending in a direction substantially perpendicular to the board and tab terminals 46*a*, 46*b*, and a leg portion 46*d* arranged between the board terminal 46*a* and the intermediate portion 46*c* to extend straight from the board terminal 46*a* and substantially perpendicular to the intermediate portion 46*c* (FIG. 1). The stationary contact 44 is made of a desired contact material, and is secured to a surface of the intermediate portion 46*c* at a side facing the board terminal 46*a*, by, e.g., caulking (FIG. 3).

The movable contact member 50 is formed by stamping and bending an electrically conductive sheet-metal material into a predetermined shape, and includes a pin-shaped board terminal 50*a* arranged at one end, a flat plate-like tab terminal 50*b* arranged at the other end to extend substantially parallel to the board terminal 50*a*, a flat plate-like intermediate portion 50*c* extending in a direction substantially perpendicular to the board and tab terminals 50*a*, 50*b*, and a leg portion 50*d* arranged between the board terminal 50*a* and the intermediate portion 50*c* to extend in a crank manner from the board terminal 50*a* and substantially perpendicular to the intermediate portion 50*c* (FIG. 2). A contact spring element 50*e* formed from a thin plate made of, e.g., a phosphor bronze, is connected to the intermediate portion 50*c* in a cantilevered manner by, e.g., caulking, and extends in a direction substantially perpendicular to the terminals 50*a*, 50*b* (FIG. 3). The movable contact 48 is made of a desired contact material, and is secured to a surface of a free end region of the contact spring element 50*e* at a side facing the tab terminal 50*b* by, e.g., caulking (FIG. 3).

The stationary contact member 46 is fixedly attached to the base 12 by inserting the intermediate portion 46*c* into the second receptacle 24 of the base 12. On the other hand, the movable contact member 50 is fixedly attached to the base 12 by inserting the intermediate portion 50*c* and the contact spring element 50*e* into the second receptacle 24 of the base 12. When both contact members 46, 50 are attached to the base 12 in proper positions, the stationary contact 44 and the movable contact 48 are disposed in oppositely facing to each other in the interior of the second receptacle 24, and are spaced from each other at a predetermined distance in a vertical direction as seen in the drawings. The movable contact 48 is displaceable in a swing manner in response to a rocking action of the armature 30, and comes into contact with the stationary contact 44 opposing to the movable contact 48 in a swinging direction of the latter so as to close a make contact, as described later. Thus, the electromagnetic relay 10 according to the illustrated embodiment is configured so that the contact section 16 does not have a break contact.

As shown in FIG. 3, the top plate 12*a* and one of the side plates 12*b* of the base 12 are provided with slits 52 for tightly receiving a proximal end region of the tab terminal 46*b* adjacent to the intermediate portion 46*c* and one end region of the intermediate portion 46*c* adjacent to the leg portion 46*d*, of the stationary contact member 46, respectively. Further, one of the side plates 12*b* of the base 12 is provided with a channel 54 for receiving the leg portion 46*d* of the stationary contact member 46. As a result, the stationary contact member 46 is held on the base 12 with the stationary contact 44 being located at a predetermined position in the second receptacle 24. Similarly, the top plate 12*a* and the other of the side plates 12*b* of the base 12 are provided with slits 56 for tightly receiving a proximal end region of the tab terminal 50*b* adjacent to the intermediate portion 50*c* and one end region of the intermediate portion 50*c* adjacent to the leg portion 50*d*, of the movable contact member 50, respectively. Further, the first end plate 12*e* of the base 12 is provided with a channel 58 for receiving the leg portion 50*d* of the movable contact member 50. As a result, the movable contact member 50 is held on the base 12 with the movable contact 48 being located at a predetermined position in the second receptacle 24.

Figure 6:
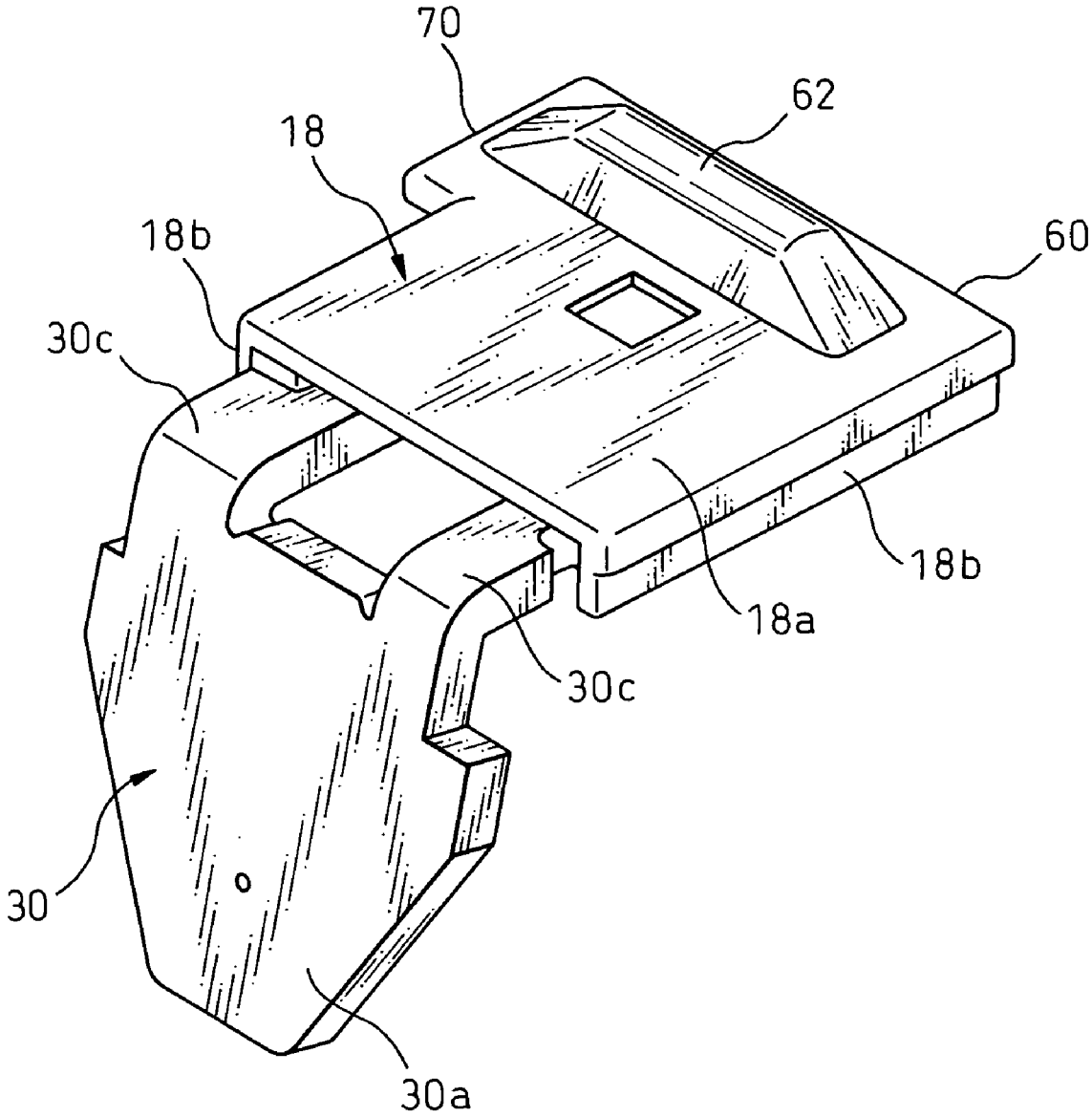
FIG. 6 is a perspective view showing an armature and an actuating member, used in the electromagnetic relay of FIG. 1.

The actuating member 18 is a plate-like member having an envelope structure integrally made of an electrically insulating resinous material, and is fixedly attached to the extending portion 30*b* of the armature 30, arranged away from the core head 36*a* of the electromagnet 28. As shown in FIGS. 6 and 7, the actuating member 18 includes a top wall 18*a* having a substantially rectangular profile in a plan view, a pair of side walls 18*b* parallel to each other and extending along a pair of edges of the top wall 18*a* to be perpendicular to the top wall 18*a*, an end wall 18*c* extending along another edge of the top wall 18*a* to be perpendicular to the top wall 18*a* and joined to both side walls 18*b*, and a bottom wall 18*d* spaced in parallel to and at a certain distance from the top wall 18*a* and extending to occupy an area substantially half of the top wall 18*a* and to be joined to both the side walls 18*b* and the end wall 18*c*. The top wall 18*a*, the side walls 18*b*, the end wall 18*c* and the bottom wall 18*d* cooperate to define an envelope part 60 for securely receiving and enclosing at least a part (a distal end region, in the embodiment) of the extending portion 30*b* of the armature 30. Further, a ridge 62 is formed on the top wall 18*a* to protrude outward on a side opposite to the envelope part 60.

Figure 4:
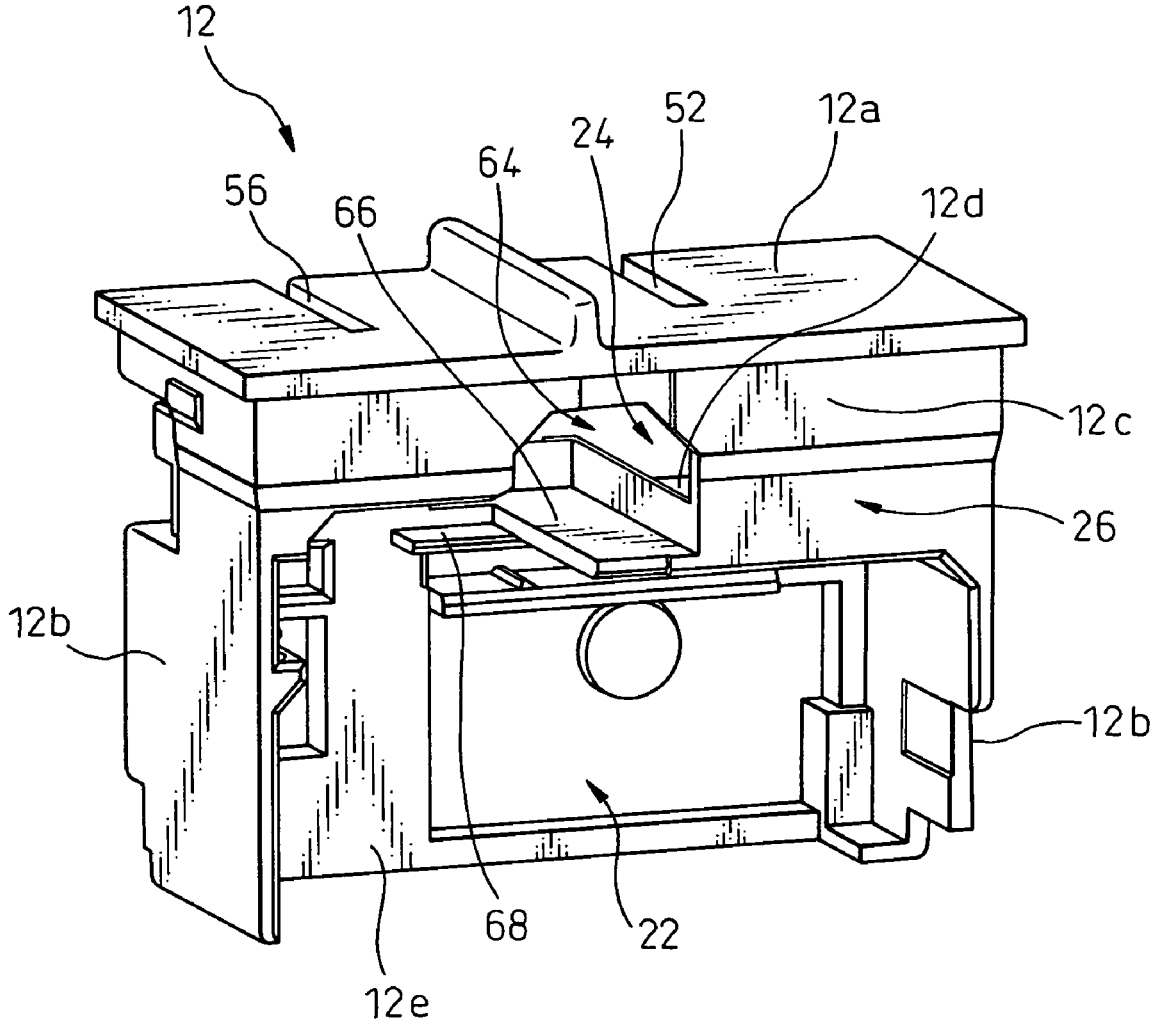
FIG. 4 is a perspective view showing a base used in the electromagnetic relay of FIG. 1.
Figure 5:
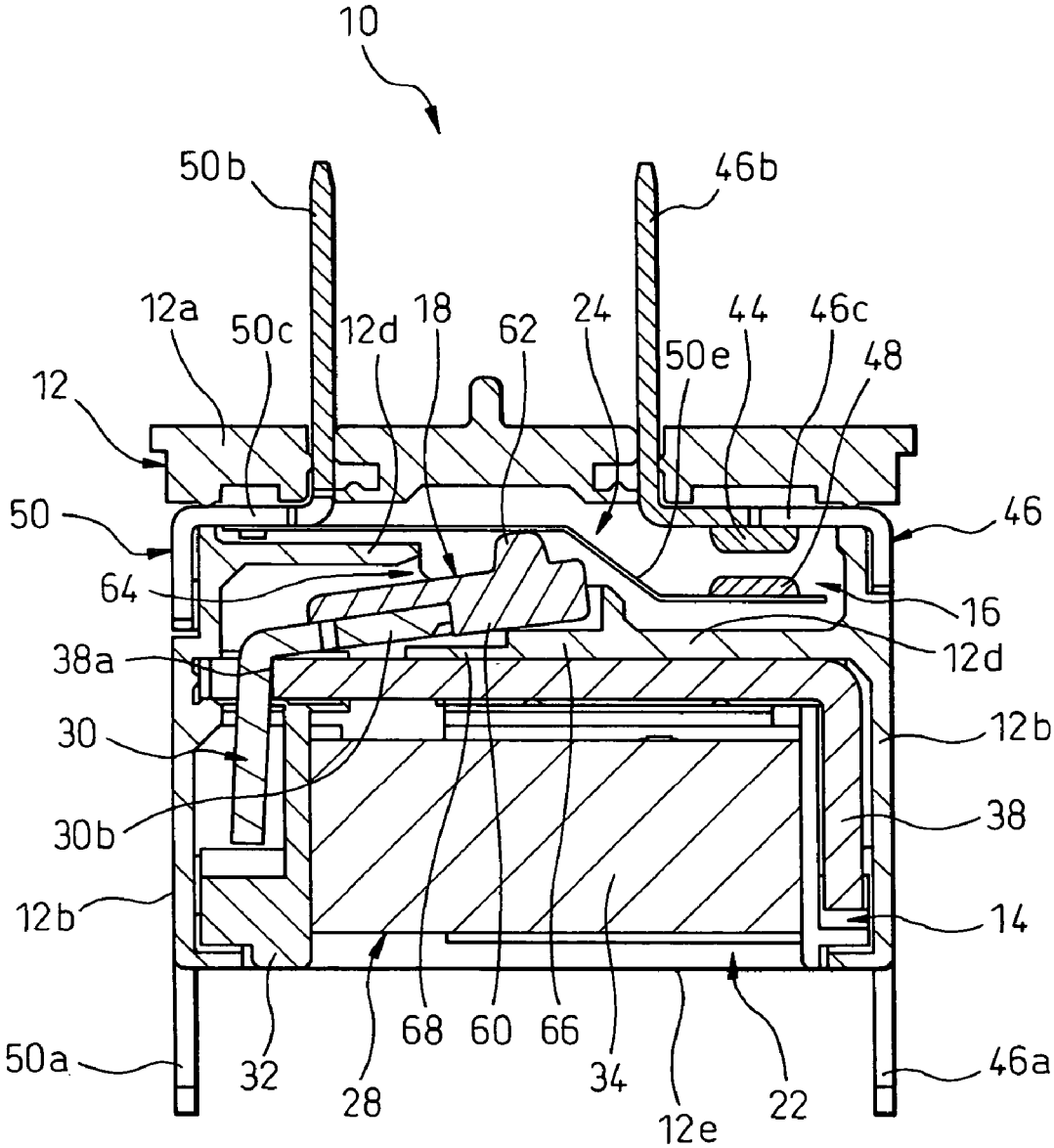
FIG. 5 is a vertical sectional view showing the electromagnetic relay of FIG. 2.

As shown in FIGS. 2, 4 and 5, the partition wall 26 of the base 12 is structured from a major part, including the side plates 12*b*, the second end plate 12*c*, the intermediate plates 12*d* and the first end plate 12*e*, as already described, and is provided in the major part with a local opening 64 communicating the first and second receptacles 22, 24 of the base 12 with each other, which is a gap formed between the pair of intermediate plates 12*d*. Then, the extending portion 30*b* of the armature 30 extends in a direction toward the second receptacle 24 of the base 12 through the local opening 64 of the major part of the partition wall 26. In other words, the extending portion 30*b* extends from the electromagnet 28 toward the contact section 16 with a part of the extending portion 30*b* substantially passing through the local opening 64. Due to this arrangement, the actuating member 18, attached to the extending portion 30*b* of the armature 30, lies through the local opening 64 of the partition wall 26 to extend between the first receptacle 22 and the second receptacle 24. Thus, the local opening 64 of the partition wall 26 is a structurally essential feature, for disposing the actuating member 18, operatively associating the electromagnet 14 with the contact section 16. In this state, the ridge 62 of the actuating member 18 abuts against the contact spring element 50*e* of the movable contact member 50 in the contact section 16, from the lower side of the contact spring element 50*e* as seen in the drawings. Then, the actuating member 18 is interlocked or linked with the rocking motion of the armature 30 caused by the action (i.e., excitation or non-excitation) of the electromagnet 28, to be shifted in a reciprocally rocking manner in a direction toward or away from the coil center axis 34*a* (FIG. 1), so as to transfer the rocking motion of the armature 30 to the contact spring element 50*e* of the movable contact member 50, as follows.

In the returned or released position as shown in FIGS. 2, 3 and 5, the armature 30 is maintained under the spring forces of the leaf spring 42 and the contact spring element 50*e* of the movable contact member 50 at a position where the attractive end portion 30*a* of the armature 30 is spaced from the head 36*a* of the iron core 36 at a predetermined distance. In this state, the actuating member 18 lies at one limit of its reciprocal rocking or shifting range, and thus the movable contact 48 formed on the contact spring element 50*e*, to which the ridge 62 is abutted, is located at a position spaced from the stationary contact 44 of the stationary contact member 46 at a predetermined distance. When the electromagnet 28 is excited, the armature 30 rocks due to the magnetic attractive force from the released position in such a direction that the attractive end portion 30*a* of the armature 30 shifts toward the core head 36*a* against the spring forces of the leaf spring 42 and the contact spring element 50*e*. At the same time, the actuating member 18 exerts a pressing force on the contact spring element 50*e* and moves toward another limit of its reciprocal rocking or shifting range, so as to elastically bend the contact spring element 50*e* in a direction toward the stationary contact member 46. At an instant when the attractive end portion 30*a* of the armature 30 is fully attracted onto or contacted with the core head 36*a*, the actuating member 18 reaches the other limit of its reciprocal rocking or shifting range, and the movable contact 48 makes conductive contact with the stationary contact 44 to close a make contact.

As described above, the electromagnetic relay 10 is configured in such a manner that the partition wall 26 of the base 12 is shaped and dimensioned so as to regulate the assembling direction of the electromagnet assembly 14 into the first receptacle 22 as to be reverse to the assembling direction of the contact section 16 into the second receptacle 24, thereby ensuring a desired creeping distance between the electromagnet assembly 14 and the contact section 16. However, in the above-described positional arrangement of the various components of the relay 10, the partition wall 26 of the base 12 is liable to insufficiently function due to the presence of the structurally essential opening 64 between the pair of intermediate plates 12*d*, so that the insulating property between the electromagnet assembly 14 and the contact section 16 may be deteriorated, especially in a spatial zone between the armature 30 in the electromagnet assembly 14 and the stationary contact 44 and movable contact 48 in the contact section 16. Therefore, in order to improve the insulating property in this spatial zone, the electromagnetic relay 10 adopts several types of insulating structures as follows.

First, the above-described envelope part 60 of the actuating member 18 acts as one of the inventive insulating structures. More specifically, the envelope part 60 of the actuating member 18 encloses in an envelope manner the distal end region of the extending portion 30*b* of the armature 30 lying in the local opening 64 of the partition wall 26 of the base 12 under the cooperation of the top wall 18*a*, the side walls 18*b*, the end wall 18*c* and the bottom wall 18*d*, so as to increase the creeping distance between the armature 30 and the stationary and movable contacts 44, 48, and thus to improve the insulating property between the electromagnet assembly 14 and the contact section 16. According to this configuration, it is possible to effectively increase the creeping distance between the electromagnet assembly 14 and the contact section 16, and thus to significantly improve the insulating property, in comparison with an actuating member having such a structure as to cover only the upper side of the extending portion of an armature, as described in, e.g., JP-A-2001-14996.

Also, as shown in FIGS. 4 and 5, the base 12 is further provided with an auxiliary part 66 of the partition wall 26, extending horizontally from one of the intermediate plates 12*d* constituting the major part of the partition wall 26, which is disposed beneath the stationary and movable contacts 44, 48 in the drawings. The auxiliary part 66 of the partition wall 26 is disposed, in close proximity to the local opening 64, between the actuating member 18 and the yoke 38 of the electromagnet 28 (FIGS. 4, 5). When the electromagnet assembly 14 is not excited and the contact section 16 is opened, the auxiliary part 66 of the partition wall 26 comes into contact with and thus supports the bottom wall 18*d* of the actuating member 18 constituting the envelope part 60. Consequently, the creeping distance between the armature 30 and the coil 34 in the electromagnet assembly 14 is increased, and thereby the insulating property between the electromagnet assembly 14 and the contact section 16 is improved. According to this configuration, it is possible to effectively increase the creeping distance between the electromagnet assembly 14 and the contact section 16, and thus to significantly improve the insulating property, in comparison with a structure in which the extending portion of an armature is placed adjacent to a yoke when a contact section is opened, as described in, e.g., JP-B-2893601.

The auxiliary part 66 of the partition wall 26 of the base 12 also includes an extension 68 locally extending along the first end plate 12*e* in the interior of the first receptacle 22, in proximity to the local opening 64 (FIGS. 4, 5). The extension 68 is disposed locally between a part of the extending portion 30*b* of the armature 30, which is exposed from the actuating member 18, and the coil 34 of the electromagnet 28, so as to increase the creeping distance therebetween, and thus to significantly improve the insulating property between the electromagnet assembly 14 and the contact section 16. In this connection, both the auxiliary partition wall 66 and the extension 68 provided in the base 12 are additionally formed to extend horizontally from one intermediate plate 12*d* of the partition wall 26 as an essential component for enabling the electromagnet assembly 14 and the contact section 16 to be assembled to the base 12 in mutually opposite directions, so that it is possible to prevent a coil arranging space being reduced and/or the external dimension in a coil radial direction (or the height dimension) of the electromagnetic relay 10 being increased, in comparison with an electromagnetic relay having such a structure as described in, e.g., JP-A-2001-14996.

Further, the actuating member 18 includes an extension 70 locally extending from the envelope part 60 in a direction toward the first end plate 12*e* of the base 12, in proximity to the local opening 64 (FIG. 6). The extension 70 increases the surface area of the actuating member 18 in the spatial zone including the local opening 64 of the base 12, so as to further increase the creeping distance between the armature 30 and the stationary and movable contacts 44, 48, and thus to significantly improve the insulating property between the electromagnet assembly 14 and the contact section 16. As the extension 70 is also formed to extend substantially horizontally from the actuating member 18 as an essential component of the electromagnetic relay 10, so that it is possible to prevent the coil arranging space being reduced and/or the height dimension of the electromagnetic relay 10 being increased.

As described above, in the electromagnetic relay 10 having the above configuration, in spite of the fact that the local opening 64 is inevitably formed in the partition wall 26 of the base 12, especially in the spatial zone between the armature 30 of the electromagnet assembly 14 and the stationary and movable contacts 44, 48 of the contact section 16, it is possible to effectively increase the creeping distance between the electromagnet assembly 14 and the contact section 16 without increasing the external dimensions of the electromagnetic relay 10, and thus to significantly improve the insulating property in this spatial zone. In particular, in the electromagnetic relay 10, it is possible to eliminate an insulating wall that extends from the base to be disposed between the coil and the yoke in the electromagnet, as described in, e.g., JP-A-2001-14996, without deteriorating the insulating property, and thereby it is possible to increase the space available for arranging the coil 34 of the electromagnet assembly 14, and thus to enhance the magnetic attractive force of the electromagnet 28, while preventing the external dimensions from increasing. Further, as the stationary contact member 46 and the movable contact member 50 in the contact section 16 are provided with the tab terminals 46*b*, 50*b*, respectively, the electromagnetic relay 10 can be applied to switch a high voltage load. From this viewpoint, it is possible for the electromagnetic relay 10 to more effectively improve the insulating property described above, in comparison with the conventional electromagnetic relay provided with the tab terminal as described in, especially, JP-B-2893601.

Figure 8A:
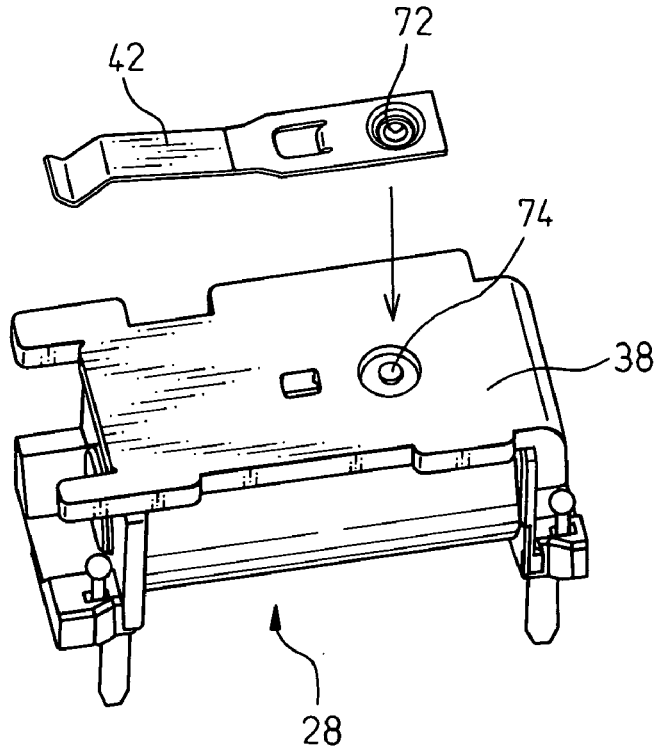
FIG. 8A is a perspective view showing an electromagnet used in the electromagnetic relay of FIG. 1 in a state before a leaf spring is attached thereto.
Figure 8B:
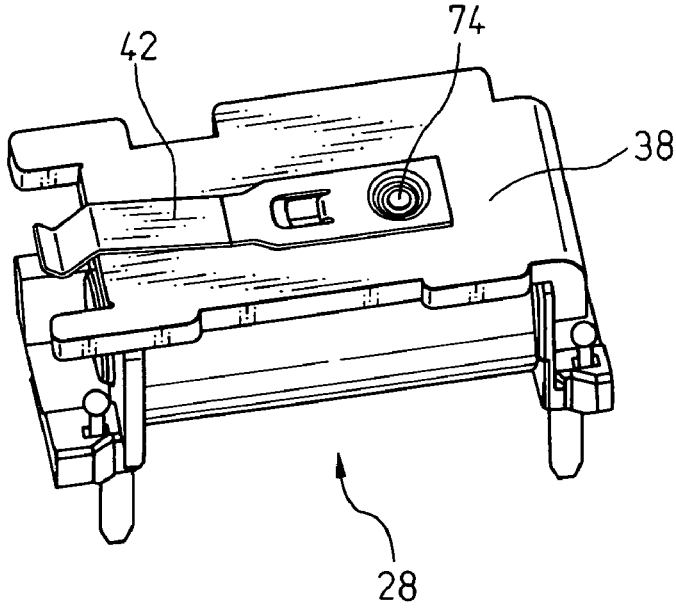
FIG. 8B is a perspective view showing the electromagnet of FIG. 8A in a state after the leaf spring is attached thereto.
Figure 9:
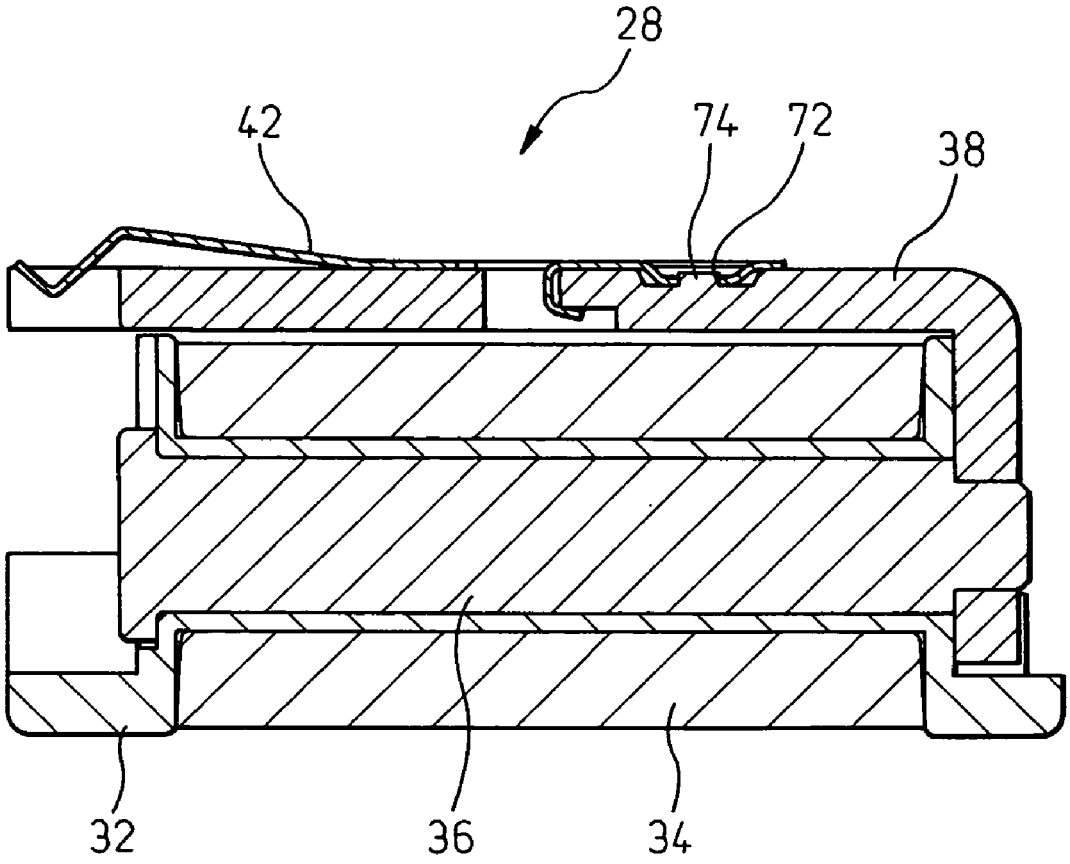
FIG. 9 is a vertical sectional view showing the electromagnet of FIG. 8B.

The electromagnetic relay 10 possesses various measures contributing to the improvement of workability in an assembling process of the electromagnetic relay 10, in addition to the above-described improvement of insulating property, as follows. For example, as shown in FIGS. 8A, 8B and 9, the leaf spring 42, rockably supporting the armature 30 in the electromagnet assembly 14 relative to the electromagnet 28, is provided at the distal end thereof attached to the yoke 38 with an attachment hole 72 penetrating through the thickness of the plate material of the spring. On the other hand, the yoke 38 is provided on the surface thereof facing outward of the electromagnet 28 with a protrusion 74 at a predetermined position. The leaf spring 42 is secured to the yoke 38 in a cantilevered manner by snap-fitting the distal-end mounting hole 72 to the protrusion 74 of the yoke 38. According to this configuration, it is possible to simplify a process for attaching the leaf spring 42 to the yoke 38 and thus to improve the workability in the assembling process, in comparison with a structure in which a leaf spring is secured to a yoke by caulking or welding at its distal end.

Figure 10:
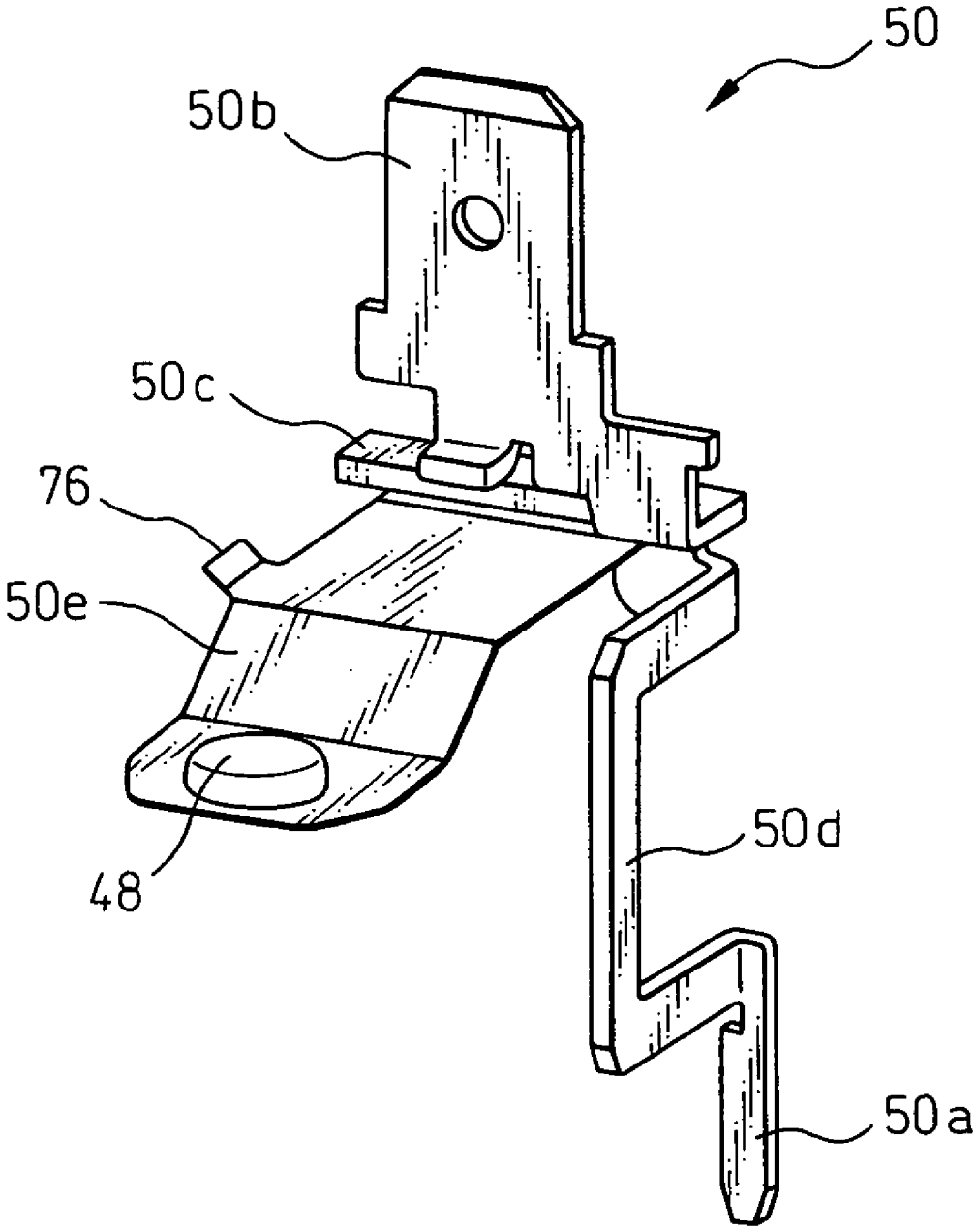
FIG. 10 is a perspective view showing a movable contact member used in the electromagnetic relay of FIG. 1.

On the other hand, in the assembling process of the electromagnetic relay 10, when the electromagnet assembly 14 and the contact section 16 are assembled into the first and second receptacles 22, 24 of the base 12, respectively, the ridge 62 of the actuating member 18 attached to the armature 30 may interfere with the contact spring element 50*e* of the movable contact member 50 and, thereby, especially the outer edge of the contact spring element 50*e* may damage the ridge 62 of the actuating member 18. In particular, in the electromagnetic relay 10, as the auxiliary part 66 of the partition wall 26 of the base 12 lies between the actuating member 18 and the yoke 38 of the electromagnet 28, the actuating member 18 is lifted upward by the auxiliary part 66 toward the contact spring element 50*e* of the movable contact member 50 during the assembling process, whereby the ridge 62 of the actuating member 18 is likely to collide with the outer edge of the contact spring element 50*e*. Therefore, in the electromagnetic relay 10, as shown in FIG. 10, the contact spring element 50*e* of the movable contact member 50 in the contact section 16 is advantageously provided with a guiding piece 76 locally protruding outward along an edge portion thereof disposed in the interior of the second receptacle 24 of the base 12 near the local opening 64. When the electromagnet assembly 14 and the contact section 16 are assembled into the first and second receptacles 22, 24 of the base 12, the guiding piece 76 mitigates the collision between the ridge 62 of the actuating member 18 and the edge portion of the contact spring element 50*e* of the movable contact member 50, and smoothly guides the ridge 62 along the bottom side of the contact spring element 50*e*, so as to avoid the damage of the ridge 62 of the actuating member 18.

Figure 11:
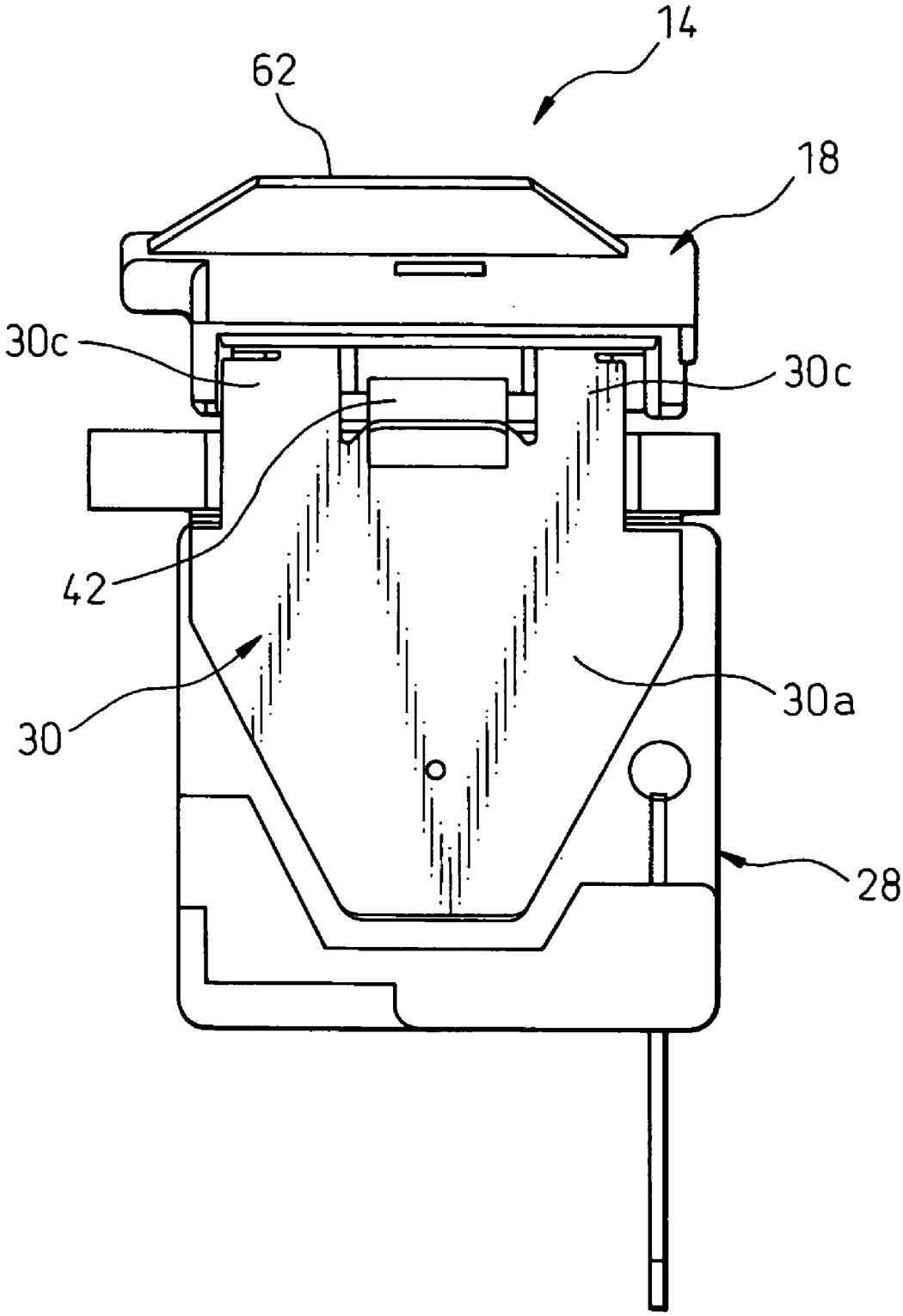
FIG. 11 is an end view showing an electromagnet assembly used in the electromagnetic relay of FIG. 1.

Still further, the electromagnetic relay 10 possesses various measures contributing to the improvement of magnetic efficiency in the electromagnet assembly 14, in addition to the above-described improvement of insulating property and of assembling workability. For example, the armature 30 of the electromagnet assembly 14 includes a first part (or the attractive end portion 30*a*) oppositely facing the core head 36*a* of the electromagnet 28, a second part (or the extending portion 30*b*) disposed at the lateral side of the coil 34 of the electromagnet 28, and a pair of connecting arm portions 30*c* integrally connecting the attractive end portion 30*a* to the extending portion 30*b* (see FIGS. 6, 7 and 11), the connecting arm portions 30*c* being dimensioned differently from each other. More specifically, one connecting arm portion 30*c* disposed near the first end plate 12*e* in the first receptacle 22 of the base 12 has a larger dimension in the width direction of the armature 30 (or in a direction perpendicular to the coil center axis) than the other connecting arm portion 30*c* disposed near the opening edge of the first receptacle 22. This configuration utilizes a surplus space between the first end plate 12*e* and the armature 30 in the first receptacle 22 of the base 12, so as to increase a cross-sectional area of a magnetic path established between the electromagnet 28 and the armature 30, and, as a result, to improve the magnetic efficiency of the electromagnet assembly 14 without increasing the external dimensions of the electromagnetic relay 10.

As described above, the electromagnetic relay according to the present invention is configured so that the components of the electromagnet assembly and the components of the contact section are assembled to the base in the mutually opposite directions, thereby establishing a superior insulating property, and thus can be utilized in various fields. In particular, in the configuration wherein a structurally essential opening, in which an actuating member operatively associating the electromagnet assembly with the contact section lies, is formed in a partition wall of the base for ensuring the insulation distance between the electromagnet assembly and the contact section, the inventive electromagnetic relay has a characteristic insulating structure for significantly improving the insulating property in a spatial zone including such a local opening. The electromagnetic relay of the present invention having the superior insulating property can particularly advantageously be applied as an electromagnetic relay with a tab terminal suitable for switching a high voltage load.

While the invention has been described with reference to specific preferred embodiments, it will be understood that the present invention is not limited to these embodiment. For example, the insulating structure of the inventive electromagnetic relay can also be adopted in the other types of electromagnetic relays in which contact sections have break contacts. In any way, it will be understood, by those skilled in the art, that various changes and modifications may be made without departing from the spirit and scope of the following claims.

The invention claimed is:

1. An electromagnetic relay comprising:

a base including a first receptacle, a second receptacle and an electrically insulating partition wall defining said first and second receptacles on mutually opposite sides of said partition wall, said partition wall including a major part and an auxiliary part extending from said major part, said major part being provided with a local opening through which said first and second receptacles communicate with each other;

an electromagnet assembly incorporated in said base to be received in said first receptacle of said base and including an electromagnet and an armature driven by said electromagnet, said armature including an extending portion extending in a direction toward said second receptacle of said base through said local opening of said major part of said partition wall, with said auxiliary part of said partition wall being disposed between said electromagnet and said extending portion of said armature;

a contact section incorporated in said base to be received in said second receptacle of said base, said contact section being separated from said electromagnet assembly at a predetermined insulation distance; and an actuating member arranged between said electromagnet assembly and said contact section and shiftable under an action of said electromagnet assembly to make said contact section open or close, said actuating member being attached to said armature of said electromagnet assembly and including an envelope part to receive and enclose at least a part of said extending portion of said armature, wherein, during an opening condition of said contact section, said envelope part of said actuating member is in contact with, and supported by, said auxiliary part of said partition wall of said base.

2. An electromagnetic relay according to claim 1, wherein said actuating member further includes an extension locally extending from said envelope part in a direction toward said base to increase said insulation distance between said electromagnet assembly and said contact section.

3. An electromagnetic relay according to claim 1, wherein:

said electromagnet of said electromagnet assembly includes a core provided with an exposed end face; and said armature further includes an attractive end portion intersecting with said extending portion and oppositely facing said end face of said core of said electromagnet and a pair of connecting arm portions integrally connecting said attractive end portion to said extending portion, said connecting arm portions being dimensioned differently from each other.

4. An electromagnetic relay according to claim 1, wherein:

said contact section includes a movable contact member provided with a contact spring element carrying a movable contact; and said contact spring element of said movable contact member is provided with a guiding piece to mitigate collision between said contact spring element and said actuating member to eliminate damage of said actuating member during an assembling process of the electromagnetic relay.

5. An electromagnetic relay according to claim 1, wherein:

said contact section includes a stationary contact member provided with a one-end board terminal, another-end tab terminal and an intermediate stationary contact, and a movable contact member provided with a one-end board terminal, another-end tab terminal and an intermediate movable contact;

said electromagnet of said electromagnet assembly includes a yoke constituting a magnetic path; and said armature is resiliently supported relative to said electromagnet by a leaf spring, said leaf spring being attached in a snap-fit manner, at one end thereof, to said yoke of said electromagnet.

* * * * *